United States Patent [19]

Wessel

[11] 4,023,567

[45] May 17, 1977

[54] MASSAGE BELT

[76] Inventor: Hans Wessel, D-5226 Reichshof 31, Wildbergerhutte, Germany

[22] Filed: Mar. 31, 1976

[21] Appl. No.: 672,332

[30] Foreign Application Priority Data

June 10, 1975 Germany ..... 7518547[U]

[52] U.S. Cl. ..... 128/63; 15/110; 15/222

[51] Int. Cl.² ..... A61H 7/00

[58] Field of Search ..... 15/110, 160, 222; 128/62 R, 63; 272/142; 401/8, 201

[56] References Cited

UNITED STATES PATENTS

| | | | |
|---|---|---|---|
| 1,232,075 | 7/1917 | Oates | 15/222 |
| 1,746,075 | 2/1930 | Edwards | 15/222 |
| 1,885,473 | 11/1932 | Pat | 272/142 |
| 2,576,338 | 11/1951 | Gamble | 15/222 X |
| 2,615,189 | 10/1952 | Novick | 15/160 X |

FOREIGN PATENTS OR APPLICATIONS

| | | | |
|---|---|---|---|
| 799,123 | 3/1936 | France | 128/63 |
| 1,981 | 12/1889 | United Kingdom | 128/62 R |
| 991,507 | 5/1965 | United Kingdom | 15/160 |
| 1,230,364 | 4/1972 | United Kingdom | 128/63 |

*Primary Examiner*—Daniel Blum
*Attorney, Agent, or Firm*—Toren, McGeady and Stanger

[57] ABSTRACT

A massage belt is provided with nipples or nodular protuberances on one side and with brush bristles on the other side with a pair of thickened portions at the end of the belt defining ducts or passages through which rope handles may be passed to enable manipulation of the belt by a user.

7 Claims, 5 Drawing Figures

MASSAGE BELT

BACKGROUND OF THE INVENTION

The present invention relates generally to a massage belt and more particularly to a belt which is covered with brush bristles on one side and with nipples or nodular protuberances on the opposite side.

Devices of the type to which the present invention relates are known but they have the form of massage gloves which are covered on one or both sides with bristles or nipples. Such devices are not particularly suitable for back massage because the user may find it difficult to reach all parts of the back with equal facility.

The present invention is directed toward providing a device of this type which is easy to handle and more adaptable during use as an effective massage belt which may allow the user to reach all parts of the body with greater ease. Furthermore, the invention is structured so that it may be more practical as to its production.

SUMMARY OF THE INVENTION

Briefly, the present invention may be described as a massage belt comprising a first side having nipples or nodular protuberances thereon and a second side having brush bristles thereon. The two sides of the belt are joined back to back with each other and thickened portions are provided at the ends of the belt in order to define a duct or passageway at each end extending across the entire width of the belt. Rope handles are passed through the ducts at the belt ends to enable appropriate manipulation of the belt by a user. Preferably, a rigid sleeve member is inserted into each duct at the belt ends to reinforce the thickened portions and to avoid wrinkling thereof.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DETAIL DESCRIPTION OF THE PREFERRED EMBODIMENTS

Figure 1:
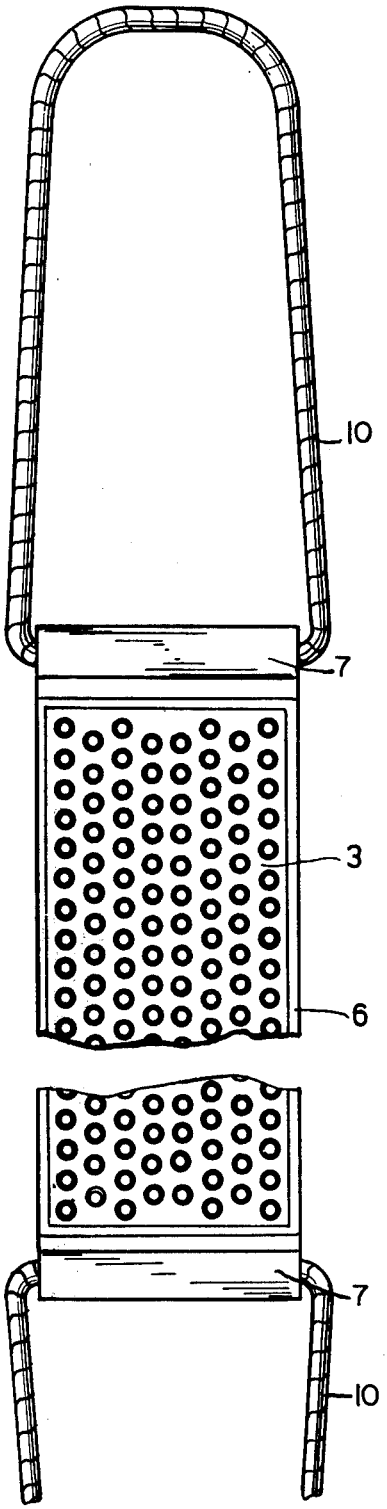
FIG. 1 is a plan view of the belt of the present invention showing the side thereof having brush bristles thereon.
Figure 2:
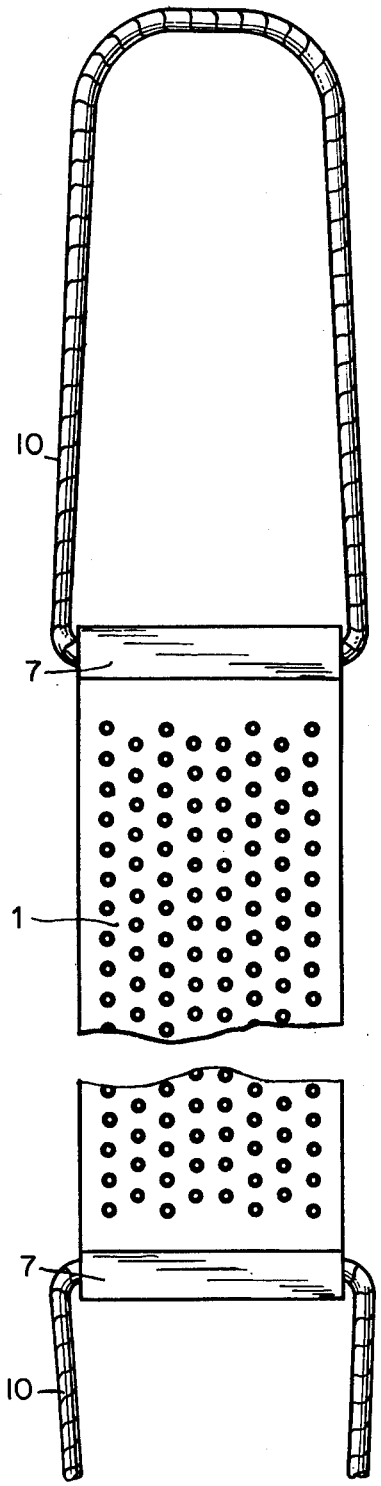
FIG. 2 is a plan view of the belt of the present invention showing the opposite side having nipples or nodular protuberances thereon.
Figure 3:
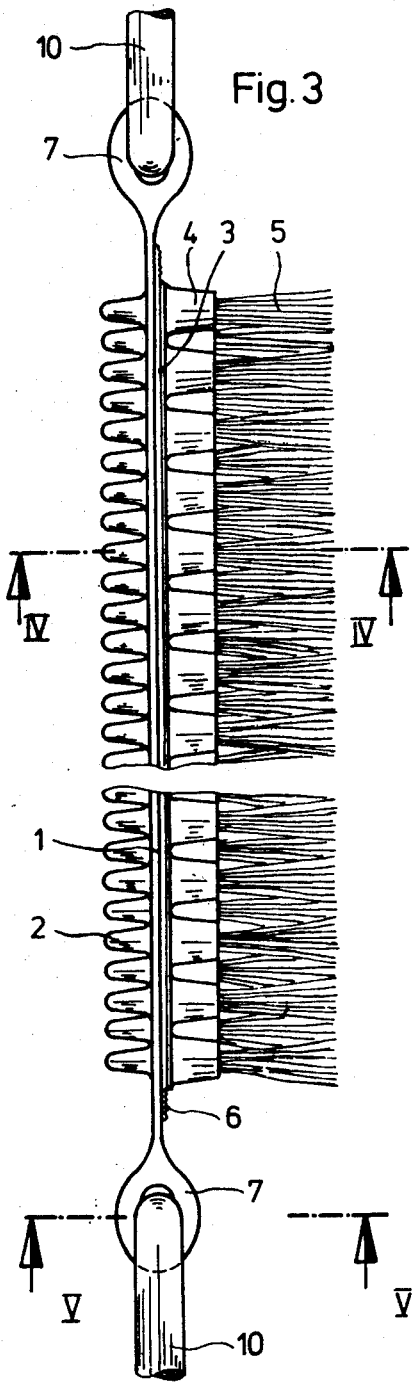
FIG. 3 is a side view of the belt of the present invention.
Figure 5:
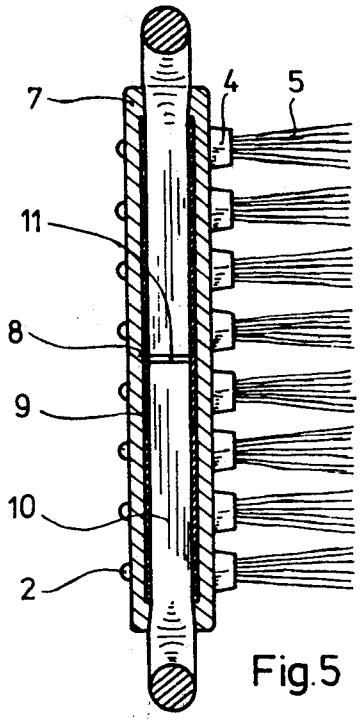
FIG. 5 is a sectional view of the belt of the present invention taken through an end portion thereof through which a rope handle is passed as viewed along the line V—V in FIG. 3.
Figure 4:
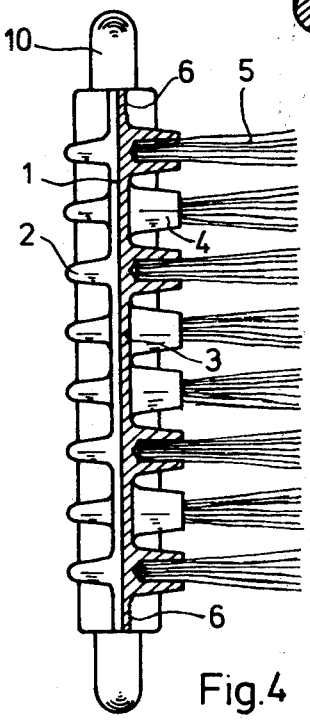
FIG. 4 is a sectional view of the massage belt of the present invention taken along the line IV—IV of FIG. 3.

Referring now to the drawings, wherein like reference numerals are used to refer to similar parts throughout the various figures thereof, the massage belt according to the present invention is depicted as consisting of a first side comprising a nipple belt portion 1 having nipples or nodular protuberances 2 thereon and a second side comprising a brush bristle belt portion 3 formed with sleeve-like protuberances 4 into which there are affixed tufts or bristles 5.

The sides of the belt are arranged back to back with both parts of the belt bearing against each other and welded or otherwise affixed together by a joinder or seam 6 extending along the periphery of the belt sides. Preferably, the seam 6 may be formed by high frequency welding so that an integral unit may be produced.

The side of the massage belt covered with the nipples 2 serves to massage the muscles of the user while the side thereof covered with the bristles is used for skin massage in order to increase body circulation. Both parts of the belt are made of elastic material, preferably soft PVC, while the bristles of the tufts 5 are made of fully synthetic fibers. The height of the sleeve-type protuberances 4 provided on the bristle belt portion 3 corresponds substantially to twice the thickness of a tuft 5.

The belt 1 has on its two narrower ends extending over the entire width of the belt a thickened portion 7 defining a duct 8. Reinforcement and rigidity for the thickened ends 7 is provided by a rigid sleeve 9 located within each of the ducts 8 to impart reinforcement and greater rigidity to the thickened ends 7. Thus, deformation of the thickened ends 7 is prevented under stress and wrinkling of the massage belt in this region is avoided.

At both ends of the belt 1 a rope handle 10 is connected to extend through the sleeves 9 in order to facilitate manipulation of the belt by a user. The rope handle 10 may consist preferably of a braided plastic cord which is coated with PVC. After the rope handle 10 has been inserted through the sleeves 9 in the ducts 8, the ends of the belt may be welded together to form an endless rope and the joined or welded portion 11 of the rope handle is pulled so that it will be located within the sleeve 9 thereby being removed from view.

The belt may be manipulated by gripping the rope handles 10, one in each hand of the user and it will be apparent that due to the particular configuration of the belt of the present invention it may be applied to various parts of the body with greater facility and ease than would otherwise be enabled by devices of different configurations. Furthermore, due to the simplicity of the construction of the belt it will be seen that it may be produced at a lower cost than other devices of the type not capable of being manipulated with the same degree of facility.

While specific embodiments of the invention have been shown and described in detail to illustrate the application of the inventive principles, it will be understood that the invention may be embodied otherwise without departing from such principles.

What is claimed is:

1. A massage belt comprising a first side having nipples extending thereover, a second side having brush bristles extending thereover, said first side and said second side being joined back to back with said nipples and said brush bristles extending on opposite sides of said belt, thickened end portions located on opposite ends of said belt and defining at said opposite ends a pair of ducts extending across the entire width of said belt, rope handle extending through each of said ducts for enabling manipulation of said massage belt and a rigid sleeve member lining each of said ducts at each of said opposite ends of said belt to reinforce said thickened end portions and to impart rigidity thereto.

2. A massage belt according to claim 1 wherein said rope handles consist essentially of braided plastic cord coated with PVC and formed with welded ends into an endless rope extending through each of said rigid sleeves with the joinder of said welded ends being located within said rigid sleeve.

3. A massage belt according to claim 1 wherein said second side of said belt having said brush bristles thereover includes sleeve-type protuberances into which said brush britles are affixed in the form of tufts.

4. A massage belt according to claim 3 wherein the height of said sleeve-type protuberances provided on said brush bristle side of said belt corresponds substantially to twice the thickness of said brush bristle tufts.

5. A massage belt according to claim 1 wherein said nipple side and said brush bristle side of said belt are joined together along peripheral portions thereof by high frequency welding.

6. A massage belt according to claim 1 wherein said nipple side and said brush bristle side of said belt consist of soft PVC and wherein said brush bristles consist of fully synthetic fibers.

7. A massage belt according to claim 1 wherein each said rigid sleeve is an aluminum tube.

* * * * *